US010672370B2

(12) United States Patent
Takegawa et al.

(10) Patent No.: US 10,672,370 B2
(45) Date of Patent: Jun. 2, 2020

(54) ROTATION STOPPER FOR CYMBAL PAD

(71) Applicant: Pearl Musical Instrument Co., Yachiyo-shi (JP)

(72) Inventors: Akito Takegawa, Yachiyo (JP); Takashi Koizumi, Yachiyo (JP)

(73) Assignee: Pearl Musical Instruments Co. (JP)

( * ) Notice: Subject to any disclaimer, the term of this patent is extended or adjusted under 35 U.S.C. 154(b) by 0 days.

(21) Appl. No.: 16/246,830

(22) Filed: Jan. 14, 2019

(65) Prior Publication Data

US 2019/0221197 A1 Jul. 18, 2019

(30) Foreign Application Priority Data

Jan. 15, 2018 (JP) ..... 2018-004434

(51) Int. Cl.
*G10D 13/06* (2020.01)

(52) U.S. Cl.
CPC ..... *G10D 13/06* (2013.01)

(58) Field of Classification Search
CPC ..... G10D 13/06
See application file for complete search history.

(56) References Cited

U.S. PATENT DOCUMENTS 3,730,047 A * 5/1973 Casavant ..... G10D 13/06 84/402
3,994,198 A * 11/1976 Herman ..... G10D 13/06 84/421
4,216,695 A * 8/1980 Hoshino ..... G10D 13/06 248/558
4,526,083 A * 7/1985 LeMert ..... G10D 13/06 403/220
5,756,912 A * 5/1998 Liao ..... G10D 13/06 84/421
8,237,039 B2 * 8/2012 Crelin ..... F16B 9/026 84/422.1
8,288,639 B2 * 10/2012 Carraro ..... G10D 13/06 84/421
8,697,970 B2 * 4/2014 Harrison ..... G10D 13/06 84/402
9,053,693 B1 * 6/2015 Wei ..... G10H 3/00
9,082,378 B2 * 7/2015 Miyashita ..... G10D 13/065
9,761,215 B2 * 9/2017 Sutton ..... G10H 3/146
9,842,574 B2 * 12/2017 McFadden ..... G10D 13/026
2016/0203804 A1 * 7/2016 Carpenter, Sr. ..... G10D 13/06 84/422.3

(Continued)

FOREIGN PATENT DOCUMENTS

JP 2007-086813 A 4/2007

*Primary Examiner* — Robert W Horn
(74) *Attorney, Agent, or Firm* — Harness, Dickey & Pierce, P.L.C.

(57) ABSTRACT

One aspect of the rotation stopper (1) for the cymbal pad (10) has a holding hole (19) provided in a holding plate (18) of the cymbal pad (10) and a holding sleeve (22) provided on a supporting rod (20) of a cymbal stand. The holding sleeve (22) is arranged to be inserted through the holding hole (19) with an amount of play in the fitting. The holding hole (19) has a plurality of engaging recesses (34) on the inner periphery. The holding sleeve (22) has an outer peripheral surface having at least one ridge (33) that engages with at least one of the engaging recesses (34) so as to deter the cymbal pad (10) from rotationally moving relative to the holding sleeve (22).

10 Claims, 5 Drawing Sheets

(56) References Cited

U.S. PATENT DOCUMENTS

| | | | | |
|---|---|---|---|---|
| 2017/0076703 | A1* | 3/2017 | Miyata | G10D 13/026 |
| 2018/0204557 | A1* | 7/2018 | Steinhauser | G10H 3/146 |
| 2019/0221197 | A1* | 7/2019 | Takegawa | G10D 13/06 |

* cited by examiner

ROTATION STOPPER FOR CYMBAL PAD

CROSS-REFERENCE TO RELATED APPLICATIONS

This application is based upon and claims the benefit of priority from Japanese Patent Application No. 2018-004434, filed Jan. 15, 2018; the entire contents of which are incorporated herein by reference.

BACKGROUND

1. Field

The present invention relates to a rotation stopper for deterring a cymbal pad from rotationally moving while an electronic drum set is being played.

2. Description of the Related Art

Cymbal pads of an electronic drum set have a built-in sensor such as a piezoelectric element that converts vibrations generated by a strike with a stick into an electric signal. Output cables for extracting electric signals detected through the sensor are connected to the cymbal pads. Accordingly, a structure for prohibiting the cymbal pad from rotationally moving (hereinafter referred to as a rotation stopper) is necessary for preventing a problem of directly striking immediately above the sensor and a problem of the output cables getting tangled or being disconnected.

For example, in a known rotation stopper, a wedge-shaped recessed portion on the cymbal pad side is put on an end portion projecting in a wedge shape on a cymbal stand side. However, since such a rotation stopper has a structure in which the wedge-shaped recessed portion loosely engages with the wedge-shaped end portion, the way the cymbal pad swings when struck varies in the circumferential direction of the cymbal pad.

Specifically, if this rotation stopper is used, the cymbal pad does not easily swing in a direction along a ridge of the end portion. In other words, compared with a metallic cymbal of an acoustic drum set (hereinafter referred to as an acoustic cymbal), a movement of the cymbal pad when struck with a stick varies depending on the position of the strike along the circumferential direction of the cymbal pad.

Accordingly, compared with an acoustic cymbal, it is difficult to delicately strike the cymbal pad with a subtle change in strength, and the way the cymbal pad swings when strongly struck varies depending on the position of the strike. Therefore, it is difficult to reproduce a realistic feeling of striking an acoustic cymbal.

SUMMARY

An aspect of the present invention is to provide a rotation stopper for a cymbal pad capable of reproducing a realistic feeling of striking an acoustic cymbal.

The rotation stopper for the cymbal pad according to an embodiment of the present invention has a holding hole provided in the cymbal pad and an axis member provided on a cymbal stand. The axis member is arranged to be inserted through the holding hole with an amount of play in the fitting. The holding hole has a plurality of first engaging portions on the inner periphery. The axis member has an outer peripheral surface having at least one second engaging portion that engages with at least one of the first engaging portions so as to deter the cymbal pad from rotationally moving relative to the cymbal stand.

With the rotation stopper for the cymbal pad according to the embodiment of the present invention, it is possible to reproduce a realistic feeling of striking an acoustic cymbal.

Additional aspects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE DRAWINGS

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION

An embodiment of the present invention will be described with reference to the drawings.

Figure 1:
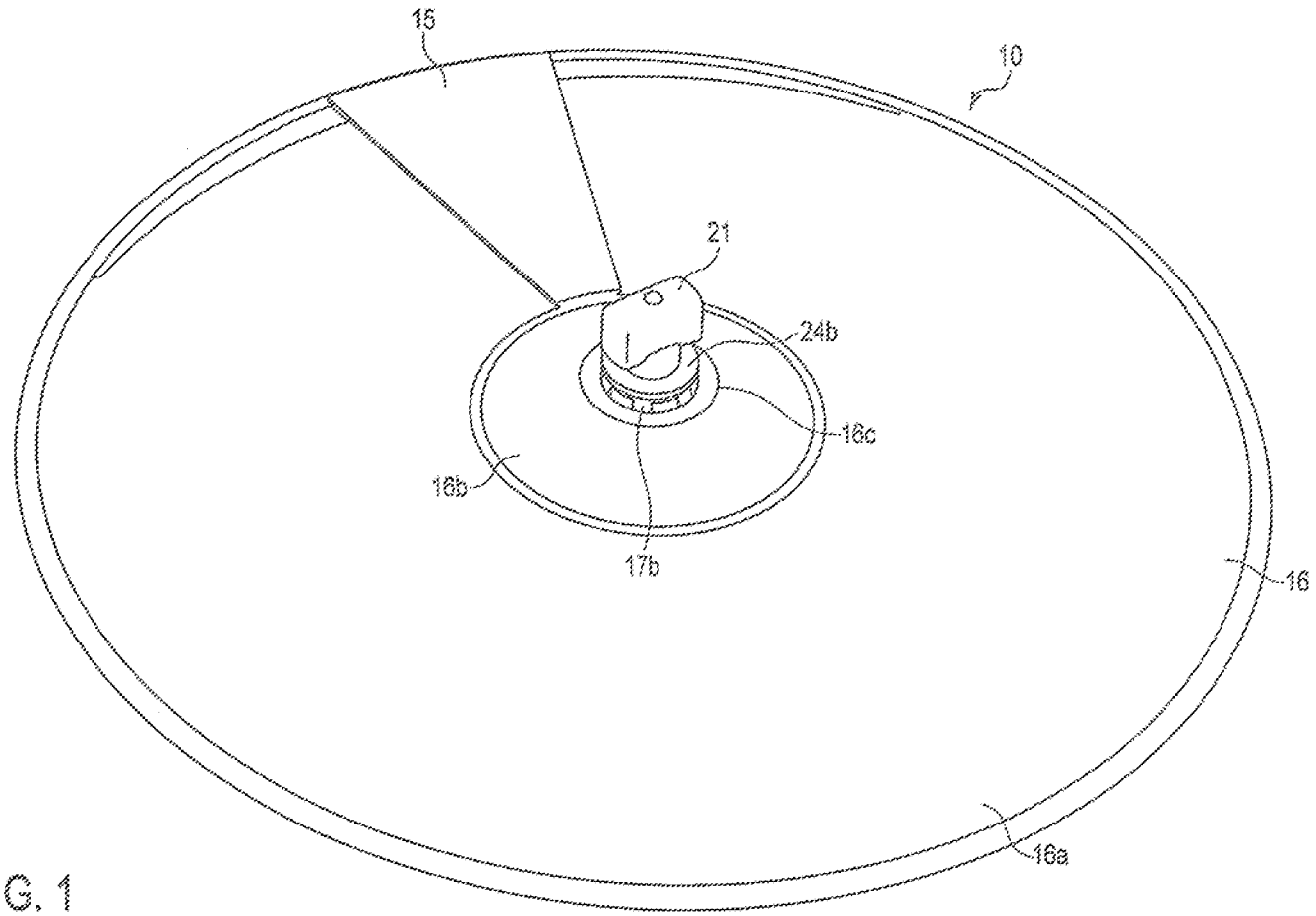
FIG. 1 is a perspective view of a cymbal pad according to an embodiment seen from diagonally above.
Figure 2:
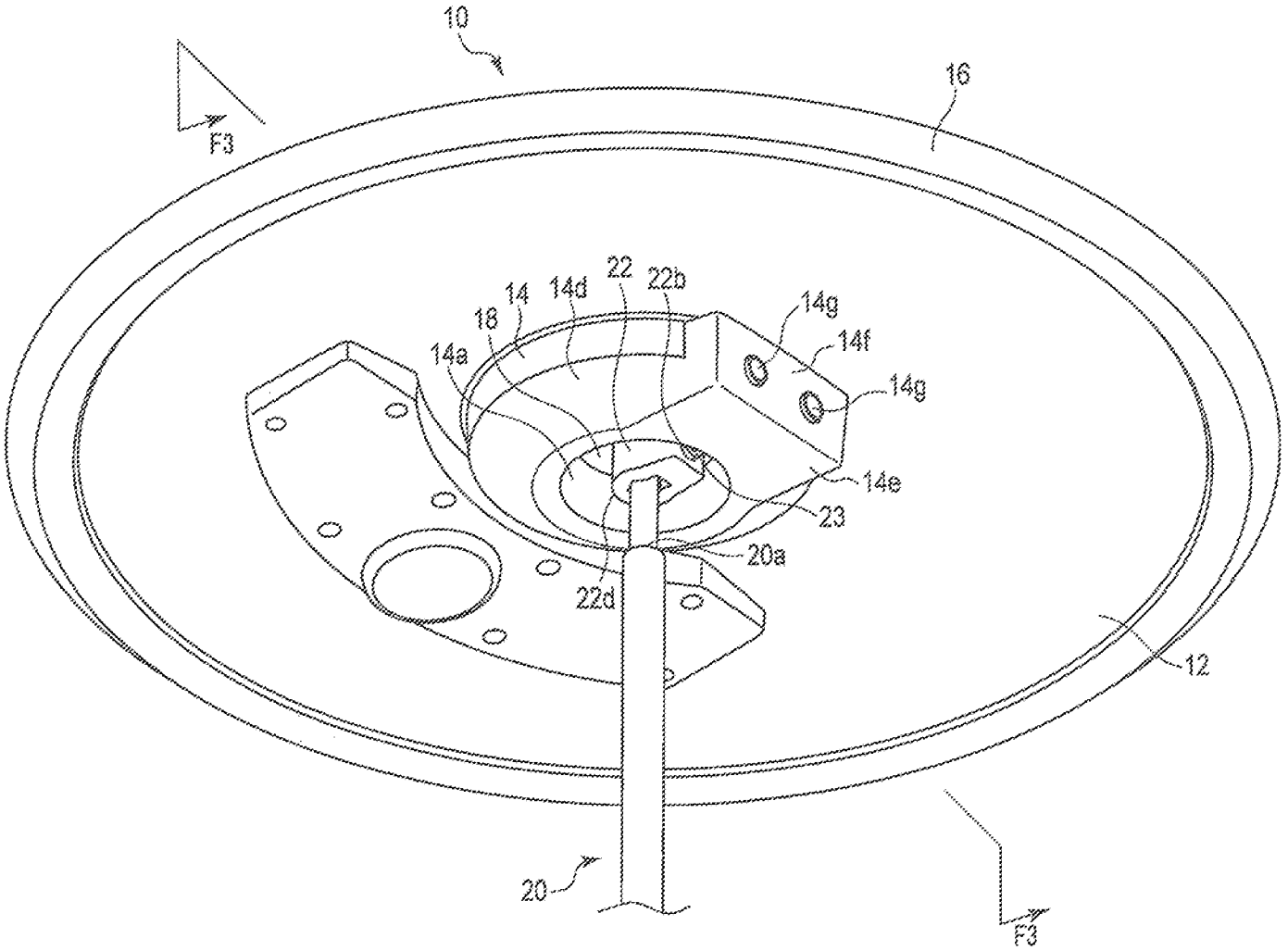
FIG. 2 is a perspective view of the cymbal pad of FIG. 1 seen from diagonally below.
Figure 3:
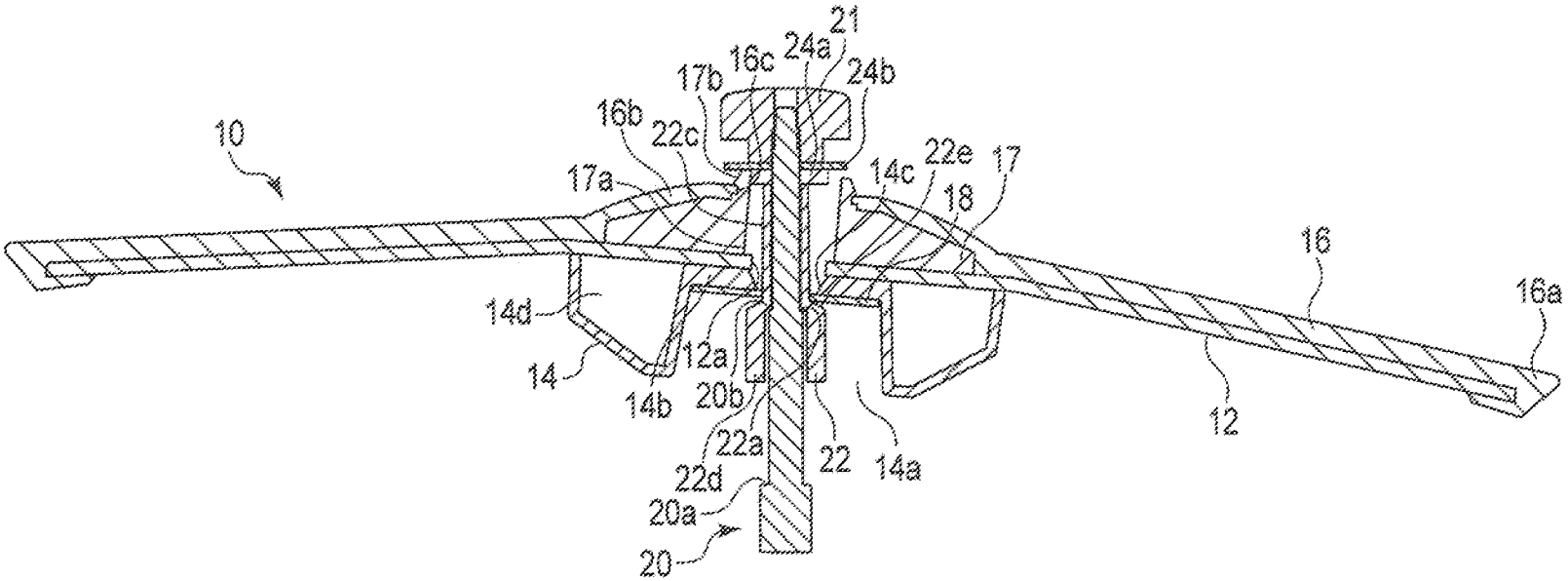
FIG. 3 is a cross-sectional view of the cymbal pad of FIG. 2 taken along line F3-F3.

FIG. 1 is a perspective view of a cymbal pad 10 having a rotation stopper 1 (see FIG. 4) according to the embodiment seen from diagonally above, and FIG. 2 is a perspective view of the cymbal pad 10 seen from diagonally below. The cymbal pad 10 is attached to the distal end of the cymbal stand. FIG. 2 partially shows only a supporting rod 20 at the distal end of the cymbal stand, and FIG. 1 does not show the cymbal stand. FIG. 3 is a cross-sectional view of the cymbal pad 10 of FIG. 2 attached to the cymbal stand, taken along line F3-F3.

In addition to the slim supporting rod 20 to which the cymbal pad 10 is attached, the cymbal stand has a supporting pole (not shown) vertically extending with the supporting rod 20 at the upper end, an adjusting mechanism (not shown) for adjusting the length of the supporting pole, a leg (not shown) for standing the supporting pole on the floor, a frame (not shown) for attaching the supporting pole, etc. The supporting rod 20 may be integrally provided at the upper end of the supporting pole. A cymbal stand may have a boom (not shown) arranged between the supporting pole and the supporting rod 20 and extended from the upper end of the supporting pole in a lateral direction. At the upper end of the supporting pole and at the end of the boom, an adjusting mechanism (not shown) for adjusting the angle of the supporting rod 20 may be provided.

Various types of cymbals may be used as a cymbal including a cymbal pad and an acoustic cymbal in a drum set including an electronic drum set and an acoustic drum set. For example, a cymbal described herein includes a hi-hat cymbal, a ride cymbal, a crash cymbal, etc. In other words, the rotation stopper 1 of the present embodiment is applicable to any of such various types of cymbals.

As shown in FIG. 3, the outer peripheral surface near the upper end of the supporting rod 20 of the cymbal stand is threaded to be screwed together with a wing nut 21. The diameter of the supporting rod 20 decreases toward its upper end in a stepwise manner, and the supporting rod 20 has annular steps 20*a* and 20*b* at the positions where the diameter changes. In the present embodiment, the steps 20*a* and 20*b* are arranged at two positions on the outer peripheral surface which are apart from each other along the longitudinal direction of the supporting rod 20.

To the supporting rod 20, an approximately cylindrical holding sleeve 22 is attached from the upper end side of the supporting rod 20, and then the approximately discoid cymbal pad 10 is attached. Subsequently, the wing nut 21 is screwed into the upper end of the supporting rod 20 with a felt washer 24*a* and a washer 24*b* interposed between an upper end of the holding sleeve 22 and the wing nut 21. As a result, the cymbal pad 10 is attached to the supporting rod 20 in such a manner that the cymbal pad 10 can slightly swing relative to the supporting rod 20. The felt washer 24*a* may be formed by other materials.

The holding sleeve 22 is attached to the position to cover the step 20*b*, which is the upper one of the two steps 20*a* and 20*b* of the supporting rod 20. On the inner peripheral surface of the holding sleeve 22, a step 22*a* to be engaged with the step 20*b* is provided. When the holding sleeve 22 is attached from the upper end side of the supporting rod 20, the step 22*a* of the holding sleeve 22 engages with the step 20*b* of the supporting rod 20 so that the holding sleeve 22 is held at the position.

The holding sleeve 22 is fixed to the supporting rod 20 at this position by a screw 23 shown in FIG. 2. The holding sleeve 22 has a screw hole 22*b* orthogonal to the axial direction and connecting the outer peripheral surface and the inner peripheral surface of the holding sleeve 22. By screwing the screw 23 into the screw hole 22*b* of the holding sleeve 22, the distal end of the screw 23 is pressed against the outer peripheral surface of the supporting rod 20 so as to fix the holding sleeve 22 to the supporting rod 20. As a result, the holding sleeve 22 becomes unable to rotationally move relative to the cymbal stand.

The holding sleeve 22 has a small-diameter portion 22*c* with a relatively small outer diameter, and a large-diameter portion 22*d* with a relatively large outer diameter. The shoulder portion 22*e*, which is between the small-diameter portion 22*c* and the large-diameter portion 22*d*, inclines outwardly from the lower end of the small-diameter portion 22*c* toward the upper end of the large-diameter portion 22*d*. The shoulder portion 22*e* is provided on the outer peripheral surface of the holding sleeve 22 at a height position which is approximately the same as the step 22*a* provided on the inner peripheral surface of the holding sleeve 22. The shoulder portion 22*e* abuts against the holding plate 18 (described later) in a state where the cymbal pad 10 is attached to the holding sleeve 22.

As shown in FIG. 3, the cymbal pad 10 has an approximately discoid main body plate 12, a frame 14 provided at the center of the underside of the main body plate 12, a cover member 16 that covers the surface of the main body plate 12, and the approximately discoid holding plate 18 that functions as the rotation stopper 1 for the cymbal pad 10 in cooperation with the aforementioned holding sleeve 22 on the cymbal stand side. FIG. 3 shows a state where the cymbal pad 10 slightly inclines relative to the supporting rod 20 of the cymbal stand.

The main body plate 12 is made of, for example, a hard resin such as ABS and polycarbonate. The main body plate 12 has, at its center, a round insertion hole 12*a* through which the holding sleeve 22 can be inserted. The main body plate 12 may be formed into a plane discoid shape, or may be slightly curved. In the present embodiment, the main body plate 12 is slightly and downwardly curved from the center toward the outer peripheral edge.

The frame 14 is fixed to the underside of the main body plate 12 in a coaxial manner. The frame 14 is made of, for example, the same material as the main body plate 12. On its bottom surface shown in the drawing, the frame 14 has an approximately cylindrical recess 14*a* for accommodating a holding plate 18. A bottom wall 14*b* of the recess 14*a* is in contact with the underside of the main body plate 12. The recess 14*a* is recessed toward the underside of the main body plate 12 upwardly as shown in the drawing.

On the bottom wall 14*b* of the recess 14*a*, an insertion hole 14*c* through which the holding sleeve 22 can be inserted is provided. The edge of the insertion hole 14*c* inclines inwardly so as to decrease the diameter of the insertion hole 14*c* from the insertion hole 12*a* of the main body plate 12 toward the edge of a holding hole 19 (described later) (see FIG. 4) of the holding plate 18. The smallest inner diameter of the insertion hole 14*c* is smaller than the outer diameter of the large-diameter portion 22*d* of the holding sleeve 22.

The cross section of the peripheral wall of the recess 14*a* is in a D-shape, which matches the shape of the holding plate 18, at least at the position adjacent to the bottom wall 14*b* (not shown). Two screw holes (not shown) corresponding to two insertion holes 18*a* (FIG. 4) of the holding plate 18 are provided on the bottom wall 14*b* of the recess 14*a*. The holding plate 18 is fixed to the frame 14 and becomes unable to rotationally move by aligning a D-shaped notch 18*b* (FIG. 4), arranging the holding plate 18 in the recess 14*a*, and fixing the holding plate 18 to the bottom wall 14*b* of the recess 14*a* with screws. It is possible to provide three or more of sets of the insertion hole 18*a* of the holding plate 18 and the screw hole on the bottom wall 14*b* of the recess 14*a*.

On the outside of the recess 14*a*, the frame 14 has an approximately annular accommodating part 14*d* that is closed between the frame 14 and the underside of the main body plate 12. A piezoelectric element and a wiring for the piezoelectric element (not shown) are arranged inside the accommodating part 14*d*. The piezoelectric element is attached to the main body plate 12, and converts vibrations of the main body plate 12 into an electric signal. The piezoelectric element may be provided at a position closer to the outer peripheral edge of the main body plate 12 than the accommodating part 14*d*.

As shown in FIG. 2, the accommodating part 14*d* has a projecting portion 14*e* protruding in a rectangular shape on one side of a radial direction. A substrate and a connector (not shown) are arranged in this projecting portion 14*e*. An end face 14*f* of the projecting portion 14*e* is provided with two insertion holes 14*g* through which a plug (not shown) of an output cable (not shown) is inserted to be plugged into the connector (not shown). The output cable is electrically connected to the piezoelectric element via the plug and the connector, and takes out electric signals detected by the piezoelectric element.

As shown in FIGS. 2 and 3, the cover member 16 is provided on the top surface side of the main body plate 12 to enfold the outer peripheral edge of the main body plate 12. The cover member 16 has a shape in which an edge portion 16*a* near the outer peripheral edge of the main body plate 12 and a cup portion 16*b* near the holding sleeve 22 are smoothly and integrally connected.

In a different type of cymbal pad (e.g., a pad for a ride cymbal), the cover member 16 may have a step or a line as a mark between the edge portion 16*a* and the cup portion 16*b*.

A membrane switch (not shown) for muting the sound of the cymbal pad is provided on the main body plate 12 along the edge portion 16*a*. The membrane switch is a switch turned on by a player pinching the edge of the cymbal pad 10 with fingers. The sound of the cymbal is muted by pressing this switch after striking the cymbal pad 10.

Most of the cover member 16 including the edge portion 16*a* is closely attached to the top surface of the main body plate 12. The cup portion 16*b* is formed into a domed shape curving and gradually separated from the top surface of the main body plate 12 toward the center of the main body plate 12. An insertion hole 16*c*, through which the holding sleeve 22 can be inserted and of which a diameter is larger than the diameter of the felt washer 24*a*, is provided at the center of the cup portion 16*b*.

The cover member 16 is made of rubber or synthetic resin. The cover member 16 and the main body plate 12 adhered to each other have a rigidity equivalent to an acoustic cymbal. A surface material for realizing a slip equivalent to an acoustic cymbal upon a strike with a stick may be applied on the surface of the cover member 16. By appropriately selecting the materials of the main body plate 12 and the cover member 16 and the surface material, the feeling of striking the cymbal pad can be made closer to the feeling of striking an acoustic cymbal.

A solid spacer 17 is provided between the cup portion 16*b* of the cover member 16 and the main body plate 12. The spacer 17 is formed into an approximately annular shape having an insertion hole 17*a* at the center. A membrane switch (not shown) is provided between the top surface (shown in the drawing) of the spacer 17 and the cup portion 16*b*. The membrane switch detects a strike on the cup portion 16*b*.

On the edge of the insertion hole 17*a* of the spacer 17, an annular projection 17*b* projecting through the insertion hole 16*c* of the cup portion 16*b* upwards as shown in the drawing is provided. The inner diameter of the insertion hole 17*a* extending inside the annular projection 17*b* is larger than the inner diameter of the insertion hole 12*a* of the main body plate 12, and slightly larger than the outer diameter of the felt washer 24*a*. As shown in FIG. 3, if the cymbal pad 10 inclines relative to the supporting rod 20 of the cymbal stand, the felt washer 24*a* is pressed against the inner surface of the annular projection 17*b* of the spacer 17 and deformed.

The cymbal pad 10 having the above structure is used while the output cable is connected. Accordingly, it is necessary to take measures to prevent a rotational movement of the cymbal pad 10 in order to prevent the plug of the output cable from being disconnected from the connector of the cymbal pad 10 due to a rotational movement of the cymbal pad 10 while the cymbal pad 10 is played.

As shown in FIG. 1, the cover member 16 of the cymbal pad 10 has a fan-shaped portion 15. The fan-shaped portion 15 is provided at the position to overlap with the projecting portion 14*e* (FIG. 2) of the frame 14. The cymbal pad 10 is attached to the cymbal stand in such a direction that the fan-shaped portion 15 is arranged away from the player. In other words, the optimum position to be struck is set on the side opposite from the fan-shaped portion 15, and a rotational movement of the cymbal pad 10 is prohibited so that the player strikes the optimum position with a stick.

Figure 4:
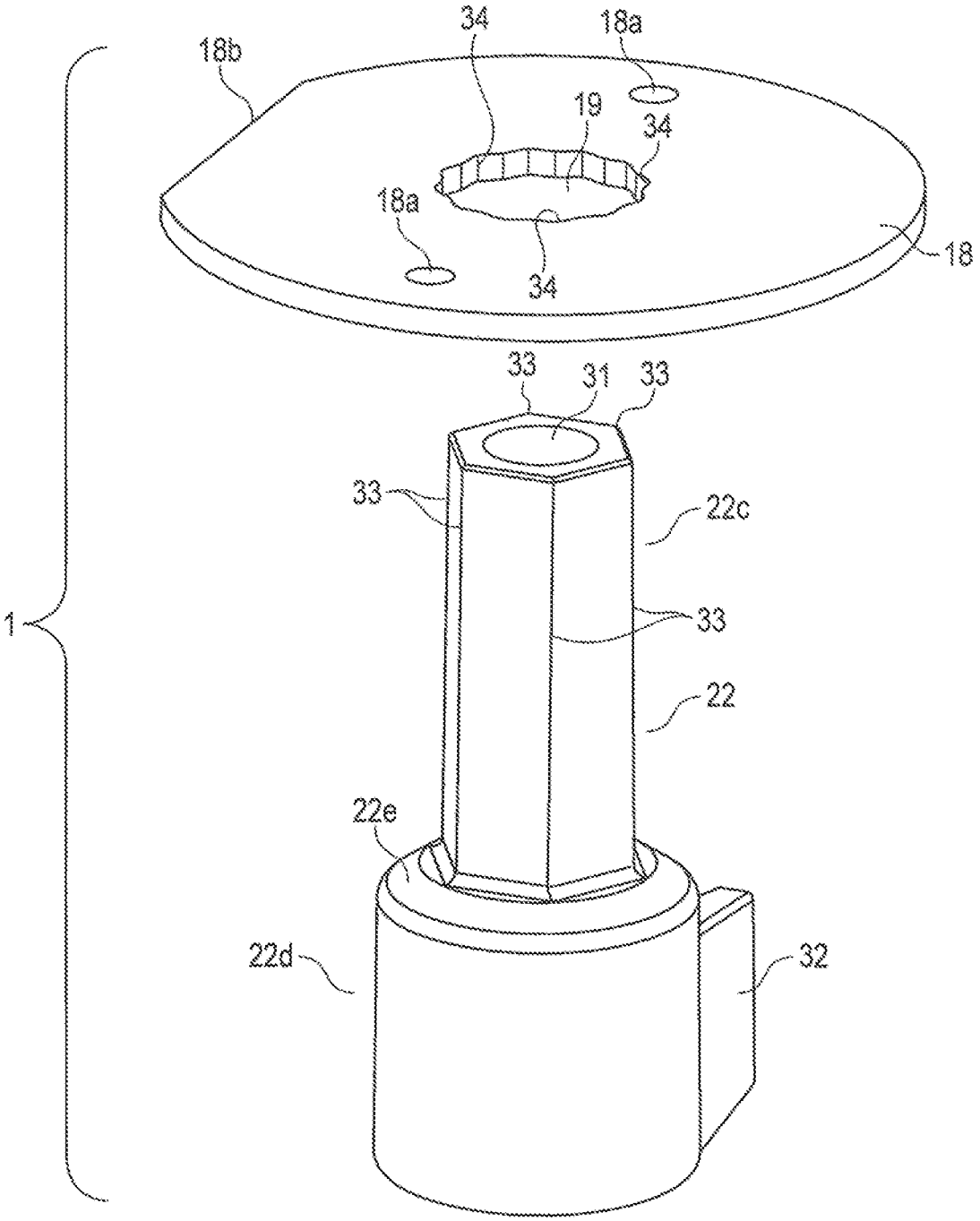
FIG. 4 is an exploded perspective view showing a rotation stopper for the cymbal pad of FIG. 1.
Figure 5:
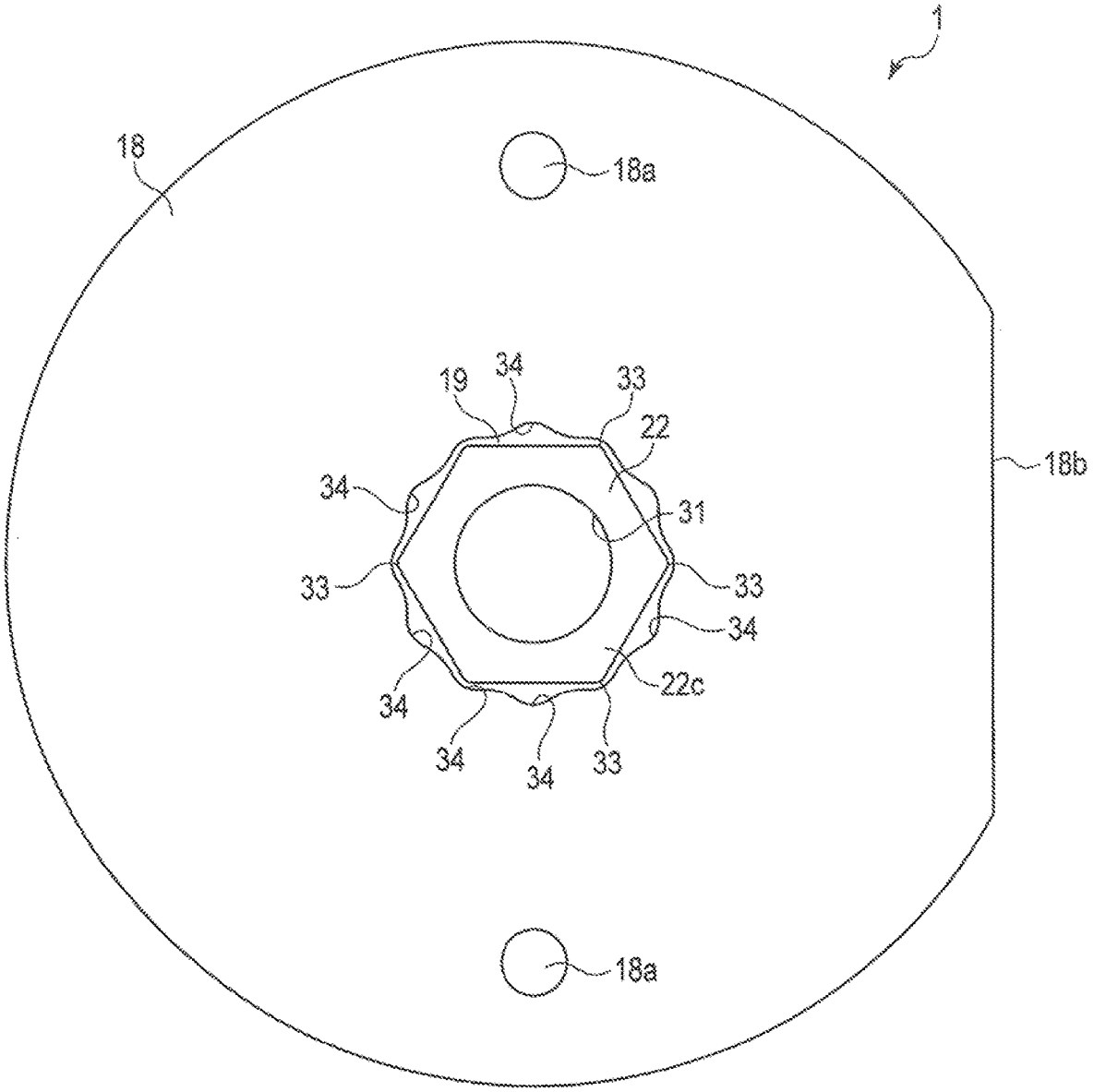
FIG. 5 is a plan view of the rotation stopper of FIG. 4 seen from the axial direction.

The rotation stopper 1 according to the present embodiment will be described in detail with reference to FIGS. 4 and 5. FIG. 4 is a perspective view showing the holding plate 18 and the holding sleeve 22 (the axis member) of the rotation stopper 1 in a separate manner. FIG. 5 is a plan view of the rotation stopper 1 seen from the axial direction. In the rotation stopper 1 of FIG. 5, the holding sleeve 22 is arranged to be inserted through the holding hole 19 of the holding plate 18. As shown in FIG. 5, the holding sleeve 22 (the small-diameter portion 22*c*) is inserted through the holding hole 19 of the holding plate 18 with a moderate amount of play.

In the present embodiment, the small-diameter portion 22*c* of the holding sleeve 22 is formed into a regular hexagonal column, and a long hole 31 for inserting the supporting rod 20 of the cymbal stand is formed at the center of the holding sleeve 22. The cross section of the small-diameter portion 22*c* orthogonal to the central axis is a regular hexagon. A boss section 32 having a screw hole 22*b* (FIG. 2) is provided on the large-diameter portion 22*d* of the holding sleeve 22 in a protruding manner. The screw 23 for fixing the holding sleeve 22 to the supporting rod 20 is screwed into the screw hole 22*b*.

On the outer peripheral surface of the small-diameter portion 22*c* of the holding sleeve 22, six ridges 33 (second engaging portions) are provided. The ridges 33 are arranged at even intervals in the circumferential direction, and are parallel to each other. In the present embodiment, the small-diameter portion 22*c* is formed into a regular hexagonal column; however, the configuration is not limited thereto. The number, the angle, and the shape of the ridges 33 may be changed discretionarily. For example, the cross section of the small-diameter portion 22*c* may be formed into other regular polygons such as a regular pentagon and a regular octagon. Alternatively, the ridges 33 may be arranged at uneven intervals in the circumferential direction of the small-diameter portion 22*c*. The small-diameter portion is only required to have at least one ridge 33.

The holding plate 18 has, at its center, the holding hole 19 for inserting the small-diameter portion 22*c* of the holding sleeve 22, in addition to the aforementioned two insertion holes 18*a* and the notch 18*b*. In the present embodiment, the holding hole 19 has a shape formed by overlapping two holes shifted at 30 degrees relative to each other. Each of the two holes is a size larger than the outer diameter of the small-diameter portion 22*c* of the holding sleeve 22, and has a regular hexagonal cross section. In other words, in the present embodiment, 12 engaging recesses 34 (first engaging portions) engageable simultaneously with all of the six ridges 33 of the holding sleeve 22 are provided on the inner periphery of the holding hole 19.

These plurality of engaging recesses 34 are arranged at even intervals along the inner periphery of the holding hole 19. The plurality of engaging recesses 34 of the present embodiment have a shape formed by smoothly connecting engaging recesses 34 adjacent to each other in the circumferential direction. In other words, the plurality of engaging recesses 34 of the present embodiment have a shape formed by alternately connecting inwardly-projecting curved surfaces with outwardly-projecting curved surfaces. On the other hand, the ridge 33 of the small-diameter portion 22*c* of the holding sleeve 22 does not necessarily have an angular edge, and may have a rounded edge that forms a curved surface.

The number of the engaging recesses 34 may be set in accordance with the number of the ridges 33 as in the present embodiment, and may be set to a number unrelated to the number of the ridges 33. In the present embodiment, the number of the engaging recesses 34 is set to twice the number of the ridges 33. For example, the number of the ridges 33 may be four, and the number of the engaging recesses 34 may be 12 which is three times the number of the ridges 33. It is desirable that the number of the engaging recesses 34 is an integral multiple of the number of the ridges 33. By setting the number of the engaging recesses 34 to an integral multiple of the number of the ridges 33, the attaching angle of the holding sleeve 22 relative to the holding plate 18 can be finely adjusted, and all of the ridges 33 of the holding sleeve 22 can be engaged with the engaging recesses 34 of the holding hole 19. As a result, the ridges 33 and the engaging recesses 34 can be securely engaged with each other.

In contrast, the cymbal pad 10 needs to be swingable relative to the supporting rod 20, and thus the small-diameter portion 22*c* of the holding sleeve 22 needs to be loosely inserted through the holding hole 19 of the holding plate 18. Furthermore, it is desirable that the cymbal pad 10 cannot rotationally move relative to the supporting rod 20 while being played under usual conditions, but rotationally moves relative to the supporting rod 20 if forced to rotationally move by the player. In this manner, the cymbal pad 10 can rotationally move relative to the supporting rod 20 if forced to rotationally move, which can prevent the supporting rod 20 and the cymbal pad 10 itself from breaking.

To achieve this, in the present embodiment, the size of the holding hole 19 of the holding plate 18 is set in such a manner that the holding plate 18 cannot rotationally move relative to the small-diameter portion 22*c* of the holding sleeve 22, and that there is a moderate amount of play between the holding hole 19 and each ridge 33 of the small-diameter portion 22*c*. In the present embodiment, the holding plate 18 in which the holding hole 19 is formed is made of a material softer than the holding sleeve 22. The above moderate amount of play between the holding hole 19 and each ridge 33 of the small-diameter portion 22*c* is set to the extent that the holding plate 18 can rotationally move relative to the small-diameter portion 22*c* accompanied by deformation of the holding plate 18. Accordingly, the holding plate 18 may be changed if the holding plate 18 is worn out, which realizes a low maintenance cost.

As described above, according to the present embodiment, the small-diameter portion 22*c* of the holding sleeve 22 fixed to the supporting rod 20 of the cymbal stand is inserted through the holding hole 19 of the holding plate 18 that is fixed to a cymbal pad 10 with an amount of play. This enables the cymbal pad 10 to swing evenly without variation in the circumferential direction upon being struck with a stick, similarly to an acoustic cymbal. Thus, according to the present embodiment, a realistic feeling of striking an acoustic cymbal can be reproduced.

Furthermore, according to the present embodiment, since the rotation stopper 1 is arranged between the cymbal pad 10 and the cymbal stand, it is possible to prevent the cymbal pad 10 from undesirably moving rotationally relative to the supporting rod 20 when the cymbal pad 10 is struck with a stick. Therefore, according to the present embodiment, there is no possibility of causing a problem of directly striking the piezoelectric element due to the cymbal pad 10 deviating from the normal position and rotationally moving, or of causing a problem in which the plug of the output cable is disconnected from the connector of the cymbal pad 10.

Additional advantages and modifications will readily occur to those skilled in the art. Therefore, the invention in its broader aspects is not limited to the specific details and representative embodiment shown and described herein. Accordingly, various modifications may be made without departing from the spirit or scope of the general inventive concept as defined by the appended claims and their equivalents.

For example, the above embodiment describes the case where a structure for prohibiting the cymbal pad 10 from moving rotationally is arranged between the holding sleeve 22 to be fixed to the supporting rod 20 of the cymbal stand and the holding hole 19 of the holding plate 18 to be fixed to the cymbal pad 10. However, the configuration is not limited thereto; the rotation stopper of the present invention may be arranged between the recess 14*a* of the frame 14 of the cymbal pad 10 and the holding plate 18. In this case, the holding plate 18 may be fixed to the supporting rod 20 of the cymbal stand.

Moreover, the above embodiment describes the case where the holding plate 18 having the holding hole 19 is arranged on the cymbal pad 10 side, and the supporting rod 20 to be inserted through the holding hole 19 is arranged on the cymbal stand side. However, the configuration is not limited thereto; the holding hole 19 may be arranged on the cymbal stand side, and the supporting rod 20 may be arranged on the cymbal pad 10 side.

The invention claimed is:

1. A rotation stopper for a cymbal pad comprising:

a holding hole provided in one of a cymbal stand or the cymbal pad and including a plurality of first engaging portions arranged at even intervals in a circumferential direction on an inner periphery of the holding hole; and an axis member provided on another one of the cymbal stand or the cymbal pad, the axis member including a small diameter portion, a large diameter portion that is larger than the small diameter portion, and a shoulder portion between the small diameter portion and the large diameter portion, the shoulder portion inclines outwardly from a lower end of the small diameter portion toward an upper end of the large diameter portion, the small diameter portion is arranged to be inserted through the holding hole such that the holding plate sits on the shoulder portion with an amount of play therebetween, the axis member having a cross section of a regular polygon of which all of apex angles function as second engaging portions engaging with the first engaging portions, and engaging the second engaging portions with the first engaging portions so as to deter the cymbal pad from rotationally moving relative to the cymbal stand, wherein a number of the first engaging portions is an integral multiple of a number of the second engaging portions.

2. The rotation stopper according to claim 1, wherein a member in which the holding hole is provided is made of a material softer than a material of the axis member.

3. A rotation stopper for a cymbal pad comprising:

a holding plate provided on one of a cymbal stand or the cymbal pad in an exchangeable manner and having a holding hole that includes a plurality of first engaging portions on an inner periphery of the holding hole; and an axis member provided on another one of the cymbal stand or the cymbal pad, the axis member including a small diameter portion, a large diameter portion that is larger than the small diameter portion, and a shoulder portion between the small diameter portion and the large diameter portion, the shoulder portion inclines outwardly from a lower end of the small diameter portion toward an upper end of the large diameter portion, the small diameter portion is arranged to be inserted through the holding hole such that the holding plate sits on the shoulder portion with an amount of play therebetween, and including;

one or more second engaging portions configured to engage with at least one of the first engaging portions so as to deter the cymbal pad from rotationally moving relative to the cymbal stand, wherein the holding plate is made of a material softer than a material of the axis member.

4. The rotation stopper according to claim 3, wherein the axis member comprises the second engaging portions of at least two or more that are configured to engage with the first engaging portions of at least two or more.

5. The rotation stopper according to claim 4, wherein a shape of a cross section of the axis member is a regular polygon of which all of apex angles function as the second engaging portions.

6. The rotation stopper according to claim 5, wherein the first engaging portions are arranged at even intervals in a circumferential direction of the holding hole, a number of the first engaging portions being an integral multiple of a number of the second engaging portions.

7. A rotation stopper for a cymbal pad comprising:

a holding hole provided in one of a cymbal stand or the cymbal pad and including a plurality of first engaging portions on an inner periphery of the holding hole; and an axis member provided on another one of the cymbal stand or the cymbal pad, the axis member including a small diameter portion, a large diameter portion that is larger than the small diameter portion, and a shoulder portion between the small diameter portion and the large diameter portion, the shoulder portion inclines outwardly from a lower end of the small diameter portion toward an upper end of the large diameter portion, the small diameter portion is arranged to be inserted through the holding hole such that the holding plate sits on the shoulder portion with an amount of play therebetween, and the axis member including one or more second engaging portions configured to engage with at least one of the first engaging portions so as to deter the cymbal pad from rotationally moving relative to the cymbal stand, wherein a member in which the holding hole is provided is made of a material softer than a material of the axis member, and the play is in a size that enables the cymbal pad to rotationally move relative to the cymbal stand accompanied by deformation of the member in which the holding hole is provided.

8. The rotation stopper according to claim 7, wherein the axis member comprises the second engaging portions of at least two or more that are configured to engage with the first engaging portions of at least two or more.

9. The rotation stopper according to claim 8, wherein a shape of a cross section of the axis member is a regular polygon of which all of apex angles function as the second engaging portions.

10. The rotation stopper according to claim 9, wherein the first engaging portions are arranged at even intervals in a circumferential direction of the holding hole, a number of the first engaging portions being an integral multiple of a number of the second engaging portions.

* * * * *